US006796297B2

(12) United States Patent
Schmied et al.

(10) Patent No.: US 6,796,297 B2
(45) Date of Patent: Sep. 28, 2004

(54) DEVICE FOR IGNITION OF AN INTERNAL COMBUSTION ENGINE

(75) Inventors: Helmut Schmied, Marbach (DE); Walter Gollin, Sachsenheim (DE); Bernhard Eisele, Rangendingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/278,277

(22) Filed: Oct. 23, 2002

(65) Prior Publication Data

US 2003/0089356 A1 May 15, 2003

(30) Foreign Application Priority Data

Oct. 23, 2001 (DE) ..... 101 52 171

(51) Int. Cl.[7] ..... F02P 3/045
(52) U.S. Cl. ..... 123/609; 123/644
(58) Field of Search ..... 123/609, 644

(56) References Cited

U.S. PATENT DOCUMENTS 4,018,202 A * 4/1977 Gartner ..... 123/609
4,836,175 A * 6/1989 Hansen et al. ..... 123/609
5,156,127 A 10/1992 Ghaem
5,758,629 A * 6/1998 Bahr et al. ..... 123/644
6,283,104 B1 * 9/2001 Ito et al. ..... 123/644
6,360,720 B1 * 3/2002 Kesler ..... 123/644
2002/0121272 A1 * 9/2002 Kraus ..... 123/644

FOREIGN PATENT DOCUMENTS

| | | |
|---|---|---|
| DE | 24 44 242 | 4/1975 |
| DE | 26 23 865 | 12/1977 |
| DE | 26 55 948 | 6/1978 |
| DE | 30 06 019 | 8/1980 |
| DE | 34 02 537 | 8/1985 |
| DE | 42 15 153 | 11/1992 |
| EP | 281 528 | 9/1988 |
| EP | 617 757 | 10/1994 |

* cited by examiner

*Primary Examiner*—Erick Solis
(74) *Attorney, Agent, or Firm*—Kenyon & Kenyon

(57) ABSTRACT

A device for ignition of an internal combustion engine is described, having a computer and an ignition output stage. A current flow through the primary side of an ignition coil is controllable by the ignition output stage. Furthermore, an arrangement is provided for measuring current flow through the primary side. A charge starting point is calculated by the computer, at which the ignition output stage begins to control a current flow through the primary side. The ignition is triggered at a preselected current through the primary side. The instant of triggering is acknowledged to the computer, which takes this instant into consideration in a further, subsequent calculation of a charge starting point.

12 Claims, 3 Drawing Sheets

DEVICE FOR IGNITION OF AN INTERNAL COMBUSTION ENGINE

FIELD OF THE INVENTION

The present invention is directed to a device for ignition of an internal combustion engine.

BACKGROUND INFORMATION

Devices for ignition of an internal combustion engine, in which a computer and an ignition output stage are provided, are conventional. The computer calculates a charge starting point, at which the ignition output stage begins to control a current flow through the primary side of the ignition coil. In conventional ignition devices, an ignition instant, at which the ignition output stage is switched into a non-conductive state, is also output by the computer.

SUMMARY

The device according to the present invention for ignition of an internal combustion engine has the advantage that the ignition occurs independently of the computer if a preset primary current value is exceeded, i.e., the ignition energy is controlled by reaching the desired shutoff current and is not a function of the output of a dwell period or dwell angle. For this purpose, only a charge starting point must be output by the computer. The computer is therefore not burdened by also outputting an ignition instant in addition to the charge starting point. The computing capacity of the computer may therefore be used for other calculations.

A flip-flop may be used as a convenient means for triggering the ignition output stage, the set input being connected to an output of the computer. In this case, the reset input of the flip-flop may be used to trigger the ignition. An example embodiment of the arrangement for detecting the current flow through the primary coil has a resistor and a comparator having a reference voltage. The signal of the comparator or other circuit parts, e.g., a unit for detection of the spark current on the secondary coil of the ignition coil or a unit for detection of the collector voltage of the ignition output stage, may be used to analyze the ignition instant.

DETAILED DESCRIPTION

Figure 1:
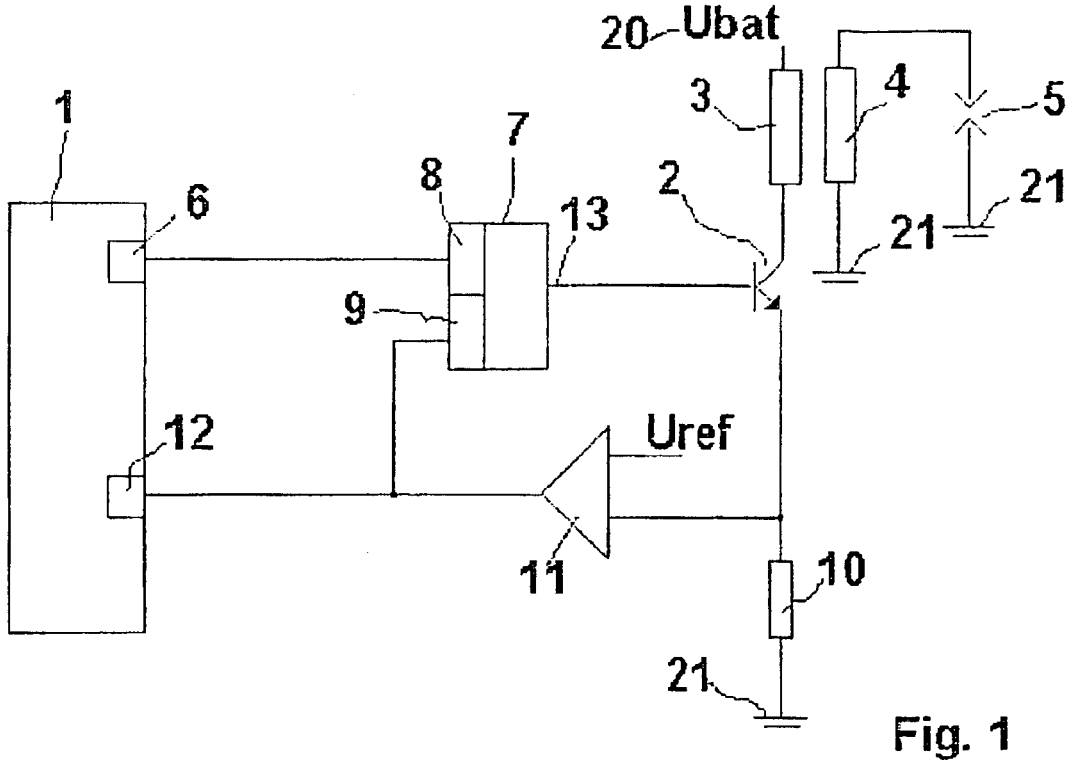
FIG. 1 shows a schematic circuit of a first exemplary embodiment of the device according to the present invention.

A first exemplary embodiment of the device according to the present invention for ignition of an internal combustion engine is illustrated in FIG. 1. The device has a microcomputer 1 having an output 6. A signal, which is fed to a set input 8 of a flip-flop 7, may be generated by the microcomputer at output 6. Flip-flop 7 has an output 13 which is connected to a control terminal of an ignition output stage 2. Ignition output stage 2 is illustrated here in simplified form as a simple transistor. The collector of ignition output stage 2 is connected to primary side 3 of an ignition coil. The other terminal of primary side 3 of the ignition coil is connected to a battery voltage 20 ($U_{BAT}$). The emitter of ignition output stage 2 is connected via a measuring shunt 10 to a chassis terminal 21. A tap, which is connected to an input of a comparator 11, is provided between ignition output stage 2 and measuring shunt 10. The other input of comparator 11 is connected to a reference voltage $U_{REF}$. An output of comparator 11 is connected to a reset input 9 of flip-flop 7 and an input 12 of computer 1. Furthermore, the ignition coil also has a secondary winding 4, in which a high voltage is induced in the event the current flow through primary side 3 is interrupted. This high-voltage signal generates an ignition spark in spark plug 5.

Figure 2:
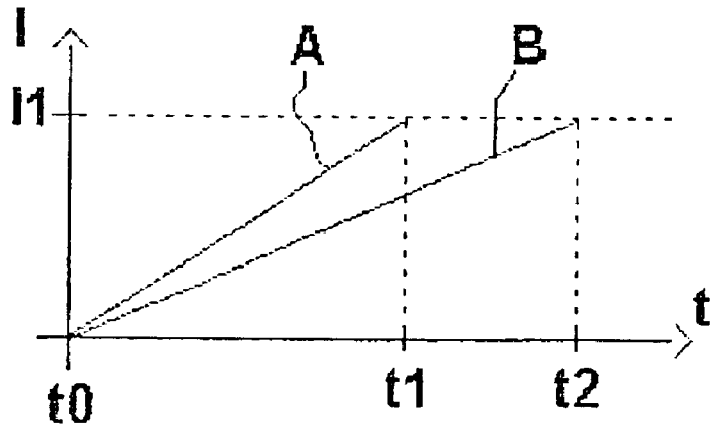
FIG. 2 shows various charging curves of the primary coil, of the device of FIG. 1.
Figure 3:
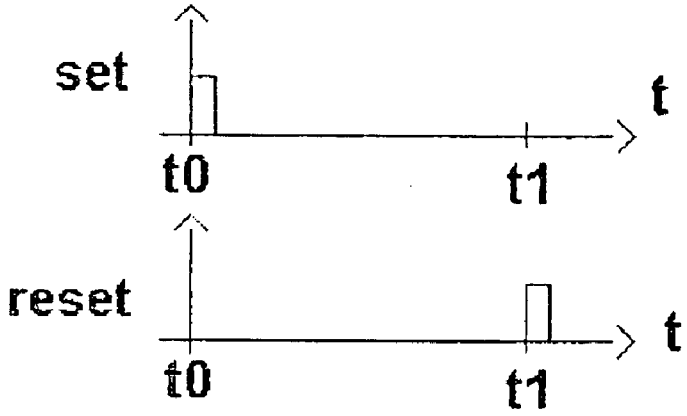
FIG. 3 shows control signals for charging curve A of FIG. 2.
Figure 4:
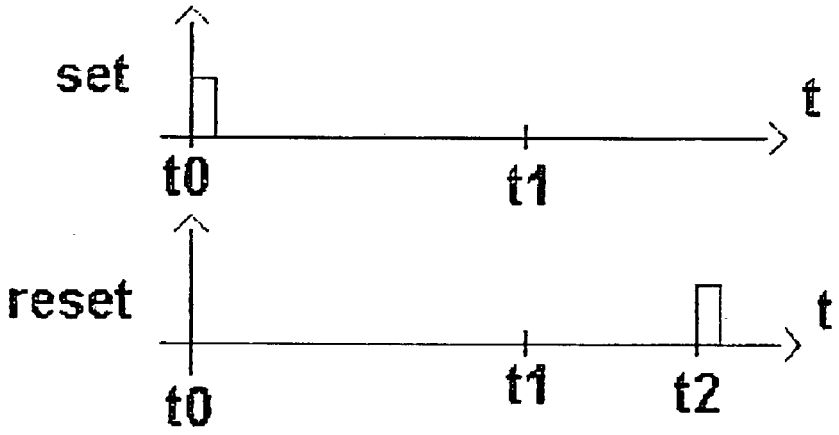
FIG. 4 shows control signals for charging curve B of FIG. 2.

The function of this device is explained with reference to FIGS. 2 and 3. In FIG. 2, current axis I is plotted against a time axis T. On current axis I, the current through the primary side of ignition coil 3 is shown. Two time axes T are also plotted in FIG. 3. The signals at set input 8 of flip-flop 7 are illustrated on the upper time axis. The signals at reset input 9 of flip-flop 7 are illustrated on the lower time axis. The signals in FIG. 3 are based on curve A of FIG. 2. FIG. 4 corresponds to FIG. 3; however, the signals shown in FIG. 4 are based on curve B of FIG. 2.

Firstly, we shall discuss the course of curve A of FIG. 2. At instant $t_0$, computer 1 generates a start signal and outputs it via output 6. This signal is illustrated on the upper time axis of FIG. 3. Flip-flop 7 is set by this signal at instant $t_0$, i.e., a corresponding output signal is generated at output 13, which switches output stage 2 to be conductive. In this way, a current flow is produced through primary side 3 of the ignition coil. However, due to the inductance of the coil, the current flow does not increase suddenly, but slowly and continuously. This increase of the current flow through the primary winding of ignition coil 3 corresponds to the increase of current flow I as is illustrated in FIG. 2. A corresponding increase of the voltage signal measured at the input of comparator 11 is caused as a function of the current flow through primary side 3 of the ignition coil. When the voltage at the input of comparator 11 then reaches value $U_{REF}$, a corresponding output signal is generated at the output of comparator 11. This signal at the output of comparator 11 is fed to input 12 of computer 1 and reset input 9 of flip-flop 7. The corresponding reset signal, which is a signal at instant $t_1$, is illustrated in the lower time axis in FIG. 3. At this instant, the charging curve of the ignition coil, as is illustrated by curve A of FIG. 2, reaches preselected current flow $I_1$, and comparator 11 generates a corresponding reset signal at flip-flop 7. Flip-flop 7 is reset by this reset signal, so that ignition output stage 2 is brought into a non-conductive state and the current flow through the primary side is suddenly stopped. Due to this measure, a suitably strong high-voltage signal is generated on the secondary side of ignition coil 4, which results in triggering of the ignition spark on spark plug 5.

In an ignition system, the computer normally assumes two control functions, specifically, of outputting both instant $t_0$, at which the charging procedure of ignition coil 3 is started, and instant $t_1$, at which the charging operation of primary winding 3 of ignition coil is ended and ignition is triggered. In the present system, however, it is only necessary for computer 1 to output one instant, specifically instant $t_0$, at which the charging of ignition coil 3 is begun. The ending of the charging procedure of ignition coil 3 then occurs automatically through comparator 11 and the resetting of flip-flop 7.

The time span between instants $t_0$ and $t_1$ is a function of the properties and usage conditions of the ignition components, such as temperature of the ignition coil or ignition output stage, or even tolerances of the ignition coil or ignition output stage. The supply voltage and the line resistances also affect the charging time of the ignition coil. This is illustrated in FIGS. 2 and 4 with reference to charging curve B of FIG. 2 and associated FIG. 4, which shows the corresponding signal curves. In FIG. 4, the signal at instant $t_0$, which sets flip-flop 7 thus initiating the current flow through ignition output stage 2 and primary side 3 of the ignition coil, is again illustrated in the upper time axis. As may be seen in the lower time axis of FIG. 4, however, the reset signal is not generated at instant $t_1$, but rather at instant $t_2$, which results in charging curve B of FIG. 2 being somewhat less steep than charging curve A. This may be caused, for example, by an elevation of temperature of the ignition coils or ignition output stages or tolerances of the ignition coils or the ignition output stages or further parameters.

According to the present invention, it is therefore suggested that computer 1 take into consideration a deviation of the ignition instant of this type, from actual desired instant $t_1$ to actually occurring ignition instant $t_2$, in the calculation of a subsequent instant $t_0$, at which the charging of the ignition coil is resumed. By comparing the duration between instants $t_0$ and $t_1$ of the preceding ignition, microcomputer 1 receives information about how long the charging procedure of each individual ignition coil lasted. This is then taken into consideration in the calculation of a subsequent instant $t_0$, in order to achieve a desired instant for the ignition. In particular, it is possible to perform these calculations individually for each cylinder and to compensate deviations of the individual ignition components in this way.

For a first ignition operation when the internal combustion engine is started, computer 1 may use a stored value. This stored value may either be permanently preselected or it may be established during a prior operation of the internal combustion engine through a measurement. Alternatively, it is also possible to provide multiple different values for this starting value, which may be selected as a function of the temperature, for example. This is expedient in particular if the time necessary for charging ignition coil 3 is strongly dependent on the temperature. The starting value may also be specific to each cylinder.

In this way, a device is provided in which the ignition energy is no longer a function of the output of a dwell time or a dwell angle, but only of the primary winding of the ignition coil reaching the desired primary current. Computer 1 only has to output one instant, i.e. charge starting point $t_0$, at which the charging of the primary side of ignition coil 3 is started.

Figure 5:
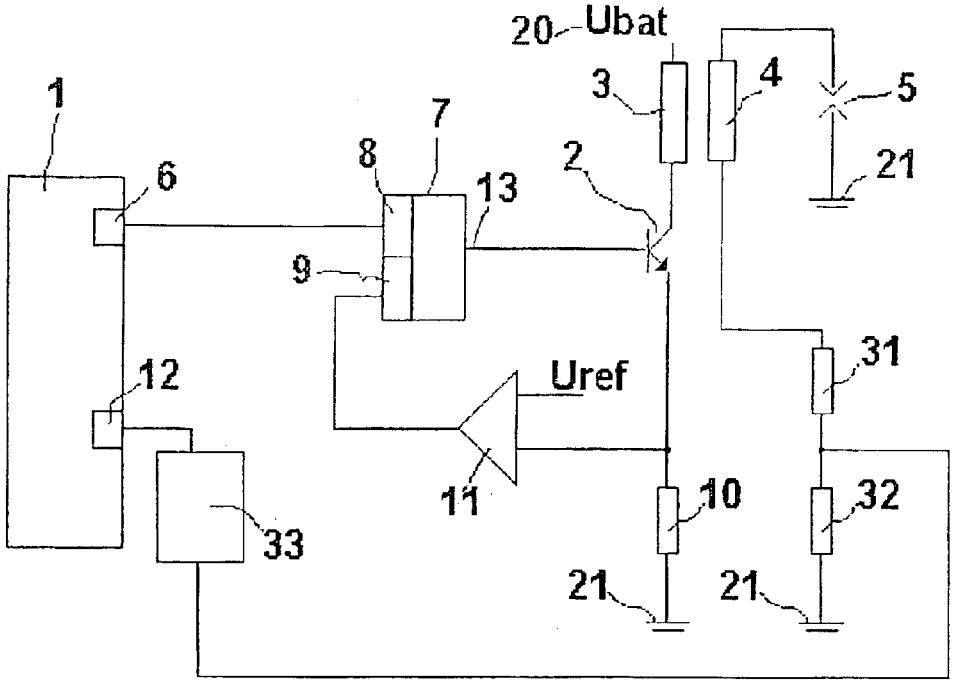
FIG. 5 shows a schematic circuit diagram of another embodiment of the present invention.

FIG. 5 shows a further exemplary embodiment, in which the completion of the ignition is not acknowledged using comparator 11, but by an additional measurement device. Identical objects to those in FIG. 1 are again indicated using reference numbers 1, 2, 3, 4, 5, 6, 7, 8, 9, 10, 11, 12, 13, 20, and 21. However, a separate device is provided to detect the completion of the ignition in the internal combustion engine. For this purpose, two resistors 31 and 32 are shown here for exemplary purposes, between which a tap of a measurement device 33 is positioned. Measurement device 33 has an output, which is in turn connected to input 12 of computer 1. Therefore, the output signal of comparator 11 is not used here to determine whether and at what instant $t_1$ an ignition has occurred. Through voltage-transformer section 31 and 32, a corresponding voltage level arises at the input of measurement device 33 as a function of an ignition spark and a current flow resulting therefrom. By evaluating this voltage, it may be determined whether and at what instant $t_1$ ignition occurred at the spark plug. In this way, computer 1 is capable of performing an appropriate adjustment of the charge starting point for the next ignition.

Figure 6:
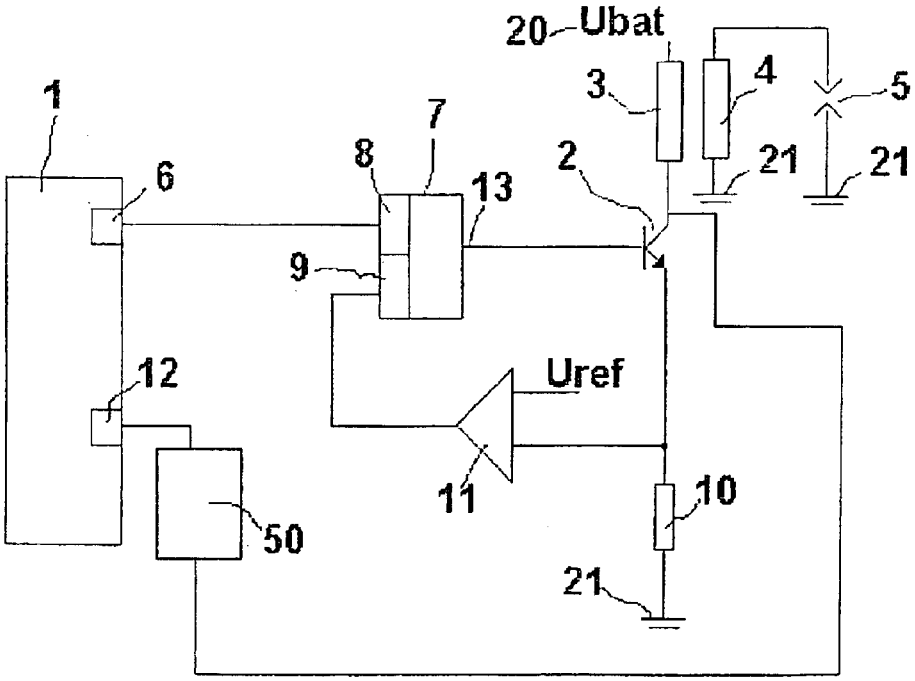
FIG. 6 shows a schematic circuit diagram of a further embodiment of the present invention.

FIG. 6 shows a further exemplary embodiment, in which the completion of the ignition is acknowledged using the voltage signal of the primary side of the ignition coil. Identical objects to those in FIG. 1 are again indicated using reference numbers 1, 2, 3, 4, 5, 6, 7, 8, 9, 10, 11, 12, 13, 20, and 21. However, to detect a completed ignition in the internal combustion engine, the collector of the ignition output stage is connected to an analyzer 50. Analyzer 50 checks, using the variation of the voltage in the primary side of the ignition coil, whether or not and at what instant an ignition occurred at the spark plug. The result of the check is then relayed to input 12 of the microcomputer.

A statement about the state of the ignition system may also be made using the methods of FIGS. 5 and 6. In addition to the acknowledgment of an ignition that has been triggered, further statements about the ignition system may also be made in this way.

Furthermore, it is also to be noted that the switching functions represented here by discrete components may also be implemented directly in ignition output stage 2 or in the computer. It is therefore possible, through an appropriate layout of output stage 2, to easily implement the flip-flop function in output stage 2 as well. Furthermore, current sensing, which was implemented here by resistor 10 and comparator 11, may also be integrated into a triggering element for the current flow through the primary side of the ignition coil.

What is claimed is:

1. A device for ignition of an internal combustion engine, comprising:

an ignition coil including a primary side and a secondary side;

an ignition output stage configured to control a current flow through the primary side of the ignition coil;

a computer configured to calculate a charge starting point at which the ignition output stage begins to control a current flow through the primary side;

a detection arrangement configured to detect the current flow through the primary side; and an arrangement separate from the computer and configured to trigger the ignition using a preselected current through the ignition coil;

wherein the computer receives a signal indicating an instant of triggering of the ignition and uses the instant of triggering of the ignition in a subsequent calculation of the charge starting point.

2. The device of claim 1, further comprising:

a flip-flop including a set input;

wherein the ignition output stage includes a control terminal connected to the computer via the flip-flop, and the computer includes an output connected to the set input of the flip-flop.

3. The device of claim 1, wherein the detection arrangement includes a measuring shunt and a comparator, the comparator having a first terminal connected between the measuring shunt and the ignition output stage and a second terminal connected to a reference voltage source.

4. The device of claim 3, wherein the computer includes an input and a signal generated by the comparator is fed to an input of the computer.

5. The device of claim 1, further comprising:

an analysis circuit configured to analyze a current signal of the secondary side of the ignition coil to detect an ignition signal.

6. The device of claim 1, further comprising:

an analysis circuit configured to analyze a voltage signal of the primary side of the ignition coil to detect an ignition signal.

7. The device of claim 1, wherein the received signal is used for an ignition circuit diagnosis.

8. The device of claim 1, wherein an ignition energy is a function of only the primary side of the ignition coil reaching the preselected current.

9. The device of claim 1, further comprising:

a first resistor;

a second resistor; and a measuring device, wherein the first and second resistors are arranged in series with the secondary side of the ignition coil, and the measuring device is arranged to measure a current flow through the first and second resistor as a result of an ignition spark.

10. The device of claim 1, wherein the detection arrangement includes an analyzer circuit connected to a collector of the ignition output stage.

11. The device of claim 10, wherein the analyzer circuit is configured to check a voltage variation in the primary side of the ignition coil.

12. A device for ignition of an internal combustion engine, comprising:

an ignition coil including a primary side and a secondary side;

an ignition output stage configured to control a current flow through the primary side of the ignition coil; and a computer configured to calculate a charge starting point at which the ignition output stage begins to control a current flow through the primary side;

a detection arrangement configured to detect the current flow through the primary side;

an arrangement configured to trigger the ignition using a preselected current through the ignition coil; and flip-flop including a set input;

wherein the computer receives a signal indicating an instant of triggering of the ignition and uses the instant of triggering of the ignition in a subsequent calculation of the charge starting point;

wherein the ignition output stage includes a control terminal connected to the computer via the flip-flop, and the computer includes an output connected to the set input of the flip-flop; and wherein the flip-flop includes a reset input, the detection arrangement being connected to the reset input of the flip-flop.

* * * * *